US011448004B2

(12) United States Patent
Guhl

(10) Patent No.: US 11,448,004 B2
(45) Date of Patent: Sep. 20, 2022

(54) FLOOR GUIDE

(71) Applicant: Beat Guhl, Ottoberg Thurgau (CH)

(72) Inventor: Beat Guhl, Ottoberg Thurgau (CH)

( * ) Notice: Subject to any disclaimer, the term of this patent is extended or adjusted under 35 U.S.C. 154(b) by 514 days.

(21) Appl. No.: 16/303,385

(22) PCT Filed: Feb. 14, 2018

(86) PCT No.: PCT/EP2018/053692
§ 371 (c)(1),
(2) Date: Nov. 20, 2018

(87) PCT Pub. No.: WO2018/153752
PCT Pub. Date: Aug. 30, 2018

(65) Prior Publication Data

US 2020/0318419 A1 Oct. 8, 2020

(30) Foreign Application Priority Data

Feb. 27, 2017 (CH) ..... 00222/17

(51) Int. Cl.
*A47H 15/00* (2006.01)
*E06B 1/70* (2006.01)
*E05D 15/06* (2006.01)

(52) U.S. Cl.
CPC ..... *E06B 1/70* (2013.01); *E05D 15/0686* (2013.01); *E05Y 2201/684* (2013.01); *E05Y 2600/452* (2013.01); *E05Y 2600/502* (2013.01); *E05Y 2600/53* (2013.01)

(58) Field of Classification Search
CPC ..... Y10T 16/35; Y10T 16/379; Y10T 16/373; Y10T 16/3819; E05D 15/0621; E05D 15/0652; E05D 15/0656; E05D 15/066; E05D 15/0686; E06B 1/70; E06B 2001/707; E05Y 2201/684; E05Y 2600/452; E05Y 2600/502; E05Y 2600/53
See application file for complete search history.

(56) References Cited

U.S. PATENT DOCUMENTS 4,352,258 A * 10/1982 Bursk ..... E06B 1/70 49/468
4,387,535 A * 6/1983 Corbo ..... E06B 1/70 49/468
9,512,656 B2 12/2016 Lee
2010/0064590 A1* 3/2010 Jones ..... E05D 15/0656 49/506
2012/0291392 A1* 11/2012 Joray ..... E05D 15/0682 52/656.5
2014/0338285 A1* 11/2014 Eyme ..... E05D 15/066 52/745.15

(Continued)

FOREIGN PATENT DOCUMENTS

DE 112013002333 2/2015
EP 2500225 9/2012

(Continued)

*Primary Examiner* — Chuck Y Mah
(74) *Attorney, Agent, or Firm* — Volpe Koenig

(57) ABSTRACT

A floor guide for sliding doors (19) is provided with a guide channel (1). A center piece (39) is arranged in the guide channel (1) and is detachably fastened to the floor of the guide channel (1) so that the profiled flange (21) at the lower edge of the sliding door (19) can be introduced and removed.

8 Claims, 5 Drawing Sheets

(56) References Cited

U.S. PATENT DOCUMENTS

| | | | | |
|---|---|---|---|---|
| 2015/0354258 | A1* | 12/2015 | Geysels | E05D 15/0686 49/506 |
| 2016/0265259 | A1 | 9/2016 | Angebault et al. | |
| 2019/0162003 | A1* | 5/2019 | Ritzi | E05D 15/0686 |
| 2020/0056419 | A1* | 2/2020 | Lee | E06B 9/52 |

FOREIGN PATENT DOCUMENTS

| | | |
|---|---|---|
| JP | 201456217 | 8/2014 |
| KR | 20120045759 | 5/2012 |
| KR | 20120119728 | 10/2012 |
| WO | 2014121350 | 8/2014 |
| WO | 2015028751 | 3/2015 |

* cited by examiner

FLOOR GUIDE

BACKGROUND

The subject matter of the invention relates to a floor guide for single-rail or multi-rail sliding door systems.

Sliding doors require running rails in the floor in order to absorb the load which in the case of large-area sliding doors can be up to several hundred kilos. The desire for a large view through said sliding doors and for a lot of light in the room leads to sliding doors often having a very narrow frame being installed nowadays, so that the available cross section remains as large as possible. In the case of such sliding doors, and as is generally the case in sliding doors, the running rails are recessed into the floor. Due to this the transition from the inside of the room to the outside of the room is level and, therefore also, trip-free.

Large-area sliding doors, in a manner corresponding to the mass thereof, require supporting elements of large dimensions, that is to say rollers on which the sliding doors are supported and readily movable. Running rails or guide rails for such running gears which are disposed so as to be recessed below the sliding doors in the floor have a comparatively large width so as to be able to distribute the high load to the rails, due to which the gap in the floor is correspondingly wide and consequently can become a tripping hazard. Moreover, the thickness of sliding doors having triple glazing is very large. Floor guides by way of which the gap width above the rails is kept so as to be as small as possible have now become known from the prior art. The sliding door, on the one hand, is not led into the floor and supported in a downward manner across the entire thickness of said sliding door, but rather only by way of a central foot which at the bottom widens like an inverted "T" and therebelow slides on rollers. The gap width in the case of such known devices is very narrow and consequently not visually disturbing because the gap width corresponds to the minor thickness of the vertically running portion of the "T". However, there is now the problem that the access to the roller bearings, running gears, or rails in the case of double guides, for example, that is to say in the case of one, two, and more, guides that lie beside one another for one, two, or more, sliding doors that run in parallel, depending on the embodiment, by fixedly installed floor covering such as, for example, tiles of stone or else wood, the latter preventing the rollers, running gears, or rails being lifted out in the case of maintenance requirements.

The central stripe-shaped portion of the floor covering, which is disposed between two guide cuts, can indeed be lifted out in the case of known floor guides, and the rails of the floor guide can thus be partially exposed. However, in the case of such an embodiment, the floor coverings that are disposed laterally to the floor guides and engage across the interior of the floor guide, the lifting of the running gears or roller bearings is prevented due to this. In the case of one of the roller bearings failing, there is thus no other option than removing floor coverings that are fixedly installed laterally to the gap. This leads to high costs and to a modification of the overall image of the floor covering in the region of the sliding doors that is no longer visually acceptable in many cases.

A sliding door system in which the frames of the two parallel-running sliding doors are disposed on roller running gears so as to be partially recessed into a guide channel, the rollers of said roller running gears running laterally to the surfaces of the sliding doors, has become known from KR 2012 0119 728. In order for such sliding doors to be able to be installed in the installation, on the one hand, and to be able to be removed from the guide channels for service or maintenance jobs, on the other hand, the region of the floor which in most instances is covered by floor coverings of wood or stone is configured so as to be retrievable. This means that three stripe-shaped floor elements in the region of two sliding doors have to be removed in the case of servicing. Such a construction in esthetic terms is not desirable since the overall impression of the floor is impeded by the three stripe-shaped floor regions that run parallel with the sliding doors across the entire length of the latter. Servicing of wide roller bearings at the cost of esthetics is indeed possible in the case of this device.

A sliding door assembly which supports the sliding doors on a very narrow web and narrow rollers is known from DE 11 2013 002 333 T5. However, the necessary gap in the floor is wider than desirable when triple glazing is used. In order for the sliding doors to be nevertheless designed to be capable of disassembly for servicing work, this publication proposes that the floor regions lateral to the sliding doors are designed so as to be removable. This in turn leads to stripe-shaped floor elements which in terms of esthetics are unsatisfactory and which negatively impact the overall impression of the floor in the case of an open sliding door as well as in the case of a closed sliding door.

A sliding door assembly having two sliding doors running in parallel is furthermore also known from KR 2012 0045 759. The central floor region between the sliding doors can be lifted out in order for said sliding door assembly to be able to be serviced. Since the supporting rollers in the case of this sliding door assembly lie above the floor surface, the maintenance of said supporting rollers is unproblematic.

In the case of the last-mentioned three sliding door assemblies unaesthetic stripe-shaped floor elements are also required in order to be able to service or repair roller bearings that are disposed below the floor surface.

SUMMARY

It is an object of the present invention to achieve a floor guide which allows access to the running gears at any time without removing the floor coverings that are disposed laterally to the running rails, and to be able to temporarily uninstall the at least one sliding door when required.

The object is achieved by a floor guide having one or more features of the invention. Advantageous design embodiments of the floor guide are described below and in the claims.

A removable central web between in each case neighboring sliding doors in the case of a single-rail or a multiple-rail embodiment of the guide channel of the floor guide enables free access to be achieved to the running gears after the stripe-shaped floor region between the running rails has been lifted, and simultaneously enables the possibility of running the double-T-shaped or T-shaped support of the sliding door out through the exposed opening unobstructed.

In one first embodiment the central web can be simply lifted from above out of the guide channel by releasing screws. In one particular advantageous design embodiment of the central web, the latter can be removed from the guide channel in a tool-free manner and said guide channel can thus be exposed so as to achieve access to the running gears, and to moreover enable the sliding doors to be run out. The design embodiment of the central web from two central web parts which, after being inserted into the guide channel, latch to one another and are non-releasably held together by placing the central stripe-shaped floor region thereon is particularly advantageous. The central webs according to the invention reach down to the floor of the guide channel such that the running gears can be laterally displaced and thereafter be retrieved from the channel without having to disassemble stripe-shaped floor portions.

BRIEF DESCRIPTION OF THE DRAWINGS

The invention will be explained in more detail in connection with a single-rail and a dual-rail floor guide and by two exemplary embodiments. In the figures.

DETAILED DESCRIPTION

Figure 1:
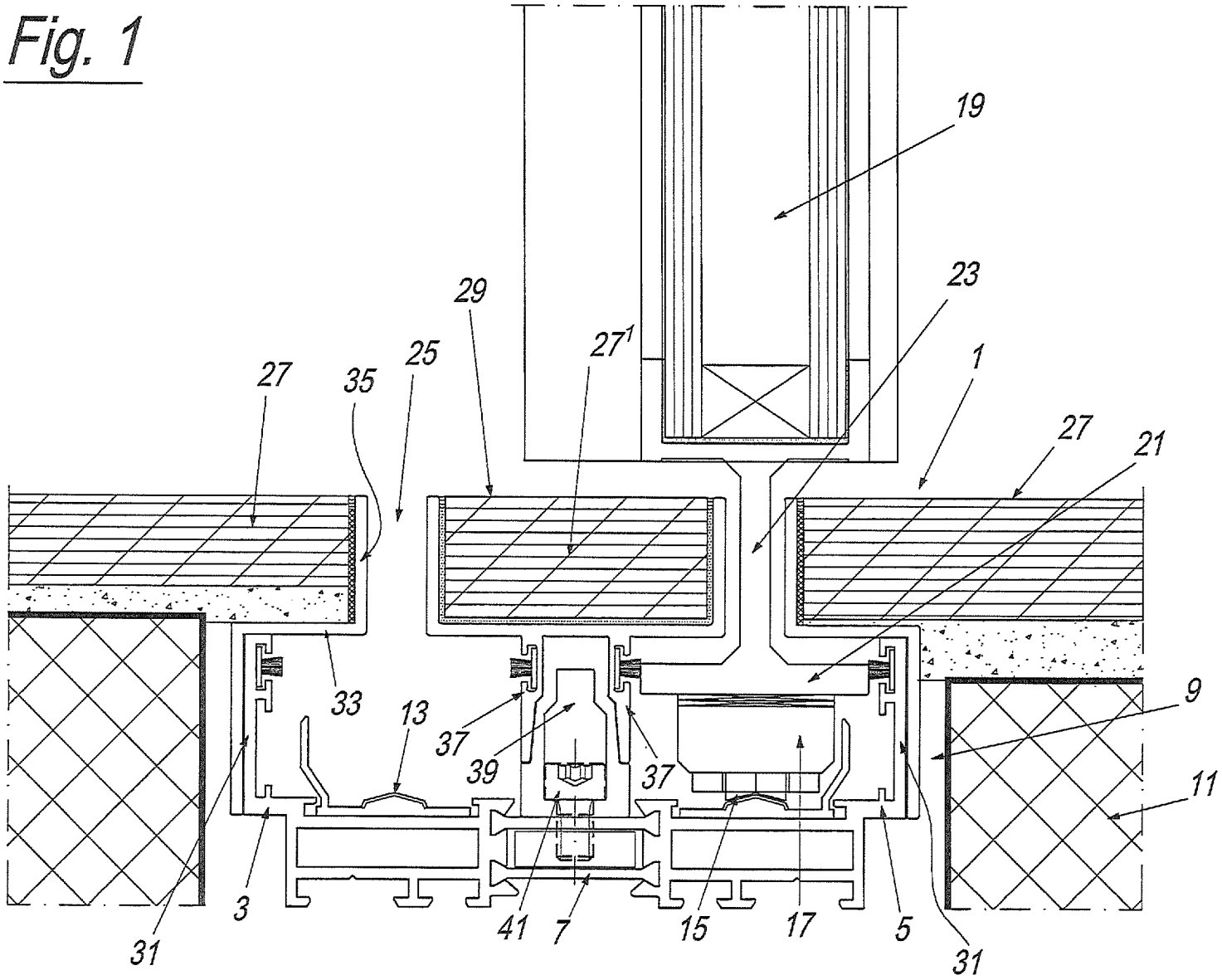
FIG. 1 shows a cross section through a dual-rail floor guide having a guide channel and a sliding door which is mounted in said guide channel and has a central web.

A guide channel having the reference sign 1 is illustrated in FIG. 1. The guide channel 1, most often produced as an extruded aluminum profile and constructed in one or two parts, comprises a left channel half 3 and a right channel half 5, the latter being constructed in a mirror image of the former. The two channel halves 3, 5 in the case of a construction in two parts are connected to one another by mostly pluggable damping webs 7. The damping webs 7 can serve as thermal insulators. The guide channel 1 is inserted into a clearance 9 in a floor 11 made from concrete and is fastened therein. The fastening of the guide channel 1 is not plotted for the sake of improved clarity. A running rail or a track 13 on which rollers 15 of a carriage unit 17 are guided is disposed in each of the channel halves 3, 5. As an alternative to running rails 13 on which rollers 15 of running gears 17 roll, rollers can be disposed on or in the floor of the guide channel 1, and profiled flanges 21 are disposed on the sliding doors 19 and are guided on the crowns at the bottom of said rollers (alternative arrangement not illustrated). Each profiled flange 21 of each sliding door 19 is connected to the sliding door 19 by way of one or a plurality of vertically running double-T-shaped support profiles 23. The width of the vertical profiled part of the support profile 23 determines substantially the width of a gap 25 through which the support profile 23 is guidable from above between floor coverings 27 and a floor support 29.

Tiles from stone, wood, metal or the like, as are commonplace nowadays in the residential construction sector, can be used as floor coverings 27. The two floor coverings 27 which are disposed on both sides of the sliding doors 19 can be comprised of an identical material or of various materials such as wood and stone. These laterally disposed floor coverings 27 protrude into the horizontally running upper opening cross section of the guide channel 1, that is to say that said floor coverings 27 form a partial cover 33 of the guide channel 1 along the profiled fins 31 of the guide channel 1. The peripheral region of the floor coverings 27 which protrudes beyond the upper cross section of the guide channel 1 is preferably supported by a Z-shaped Z-floor support 35.

The stripe-shaped floor support 29 which partially covers the upper cross section of the guide channel 1 is inserted between the two Z-floor supports 35. The two slots 25 for the support profiles 23 lie between the lateral edges of the floor support 29 and the free edges of the adjacent floor coverings 27. The floor support 29 in turn comprises an aluminum profile in the shape of a capital T, that is to say that the horizontal region of the T supports a stripe-shaped floor covering 27, for example from stone, wood, or another material, the surface thereof corresponding to that as is present in the case of the floor coverings 27 disposed on both sides. This floor covering $\mathbf{27}^1$ placed thereon can on three sides be held by a portion of the floor support 29 that is U-shaped in the cross section. Two downward protruding legs 37 are molded to the lower side of the floor support 29, said two legs 37 running in a parallel spaced apart manner. A central web 39 from aluminum, plastics material, steel, or stainless steel, which is releasably connected to the floor region of the guide channel 1 comes to lie between said two legs 37. The central web 39 is on both sides enclosed by the legs 37 in a substantially clearance-free manner. This tight clearance-free connection between the central web 39 and the legs 37 has the effect that the floor support 29 does not wobble or cannot move when stepped on by persons leaving the room which is separated by the sliding doors 19. In the first design embodiment of the invention the central web 39 that in the cross section is substantially rectangular is connected to the floor of the guide channel 1 by way of a number of screws 41 (FIG. 1) or latch by way of latching elements to the floor (not shown).

Figure 2:
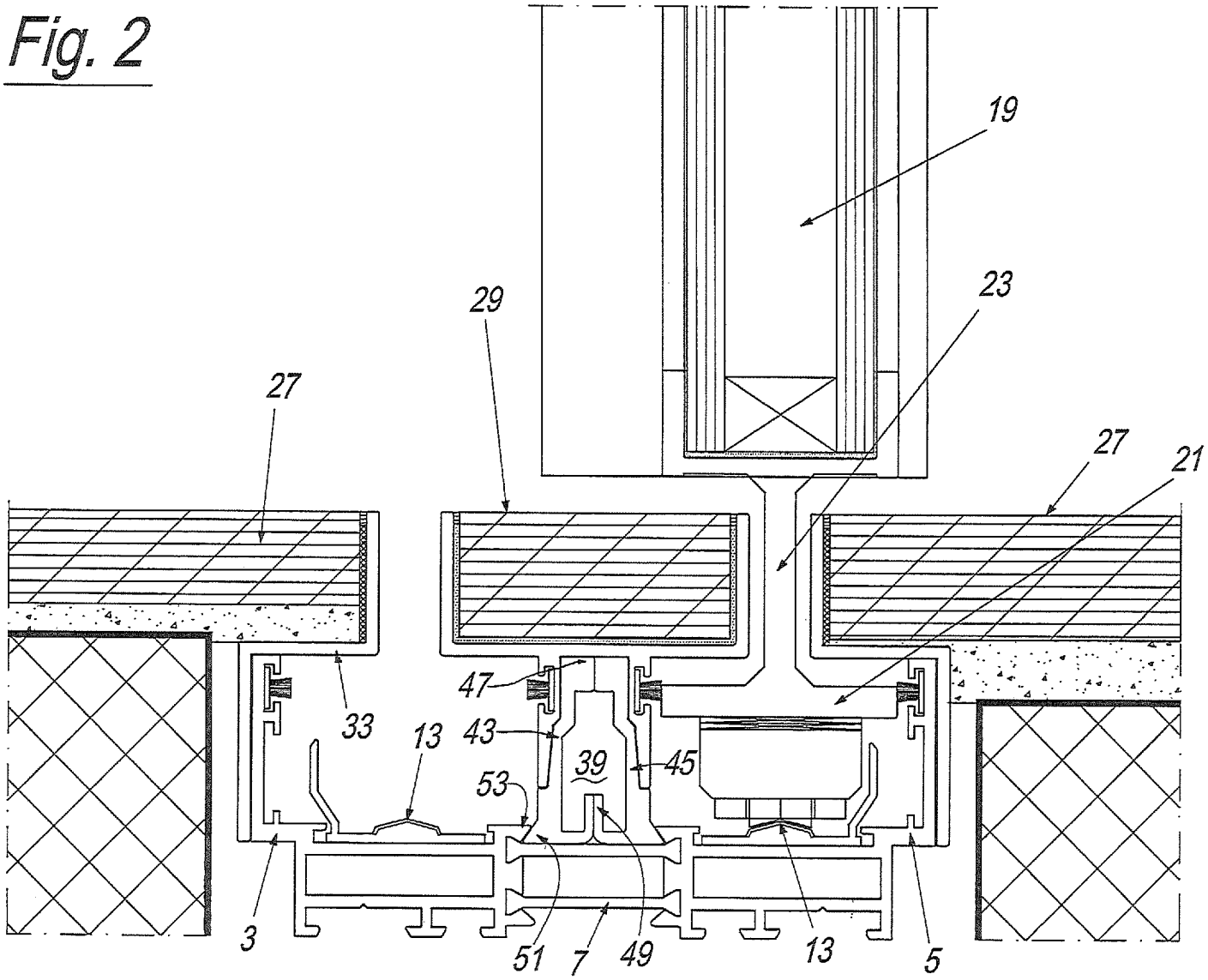
FIG. 2 shows a cross section through a dual-rail floor guide having a guide channel and a sliding door which is mounted in said guide channel and has a central web in two parts.

In the design embodiment of the invention according to FIG. 2, the central web 39 comprises two central webs, left 43 and right 45. The two right and left central webs 43, 45 are releasably connected to one another at two locations, for example, by connection elements 47 and 49. The connection elements 47, 49 can have the shape of partially mutually engaging elements or the like. The lower ends of the left and right central webs 43 and 45 can run so as to widen in a conical manner, or the lower periphery forms a step or a foot. The widening regions 51 engage behind a portion 53 of complementary configuration on the floor of the guide channel 1. When the two central webs, left and right 43, 45, are now joined to one another in such a manner that said two central webs are set onto the floor of the guide channel 1 so as to be slightly outwardly inclined, and when said two central webs are then tilted toward one another to a vertical position, as is illustrated in FIG. 2, the connection elements 47 and 49 thus engaging on another. After the floor support 29 has been plug-fitted onto the two left and right central webs 43, 45, the latter are tightly held together and support the floor support 29 in a clearance-free manner. Additional fastening means are consequently not required.

In the construction of buildings having sliding doors 19, the latter, since they are in most instances made from glass and are susceptible to damage during construction, are assembled only at the end of the construction period and in most instances also after the floor coverings 27 have been installed. However, this is not possible in the case of conventional floor guide assemblies since the introduction of the support profiles 23 on the lower edges of the sliding doors 19 can then no longer be guided through between the central web 39 and the Z-floor supports. Consequently, the sliding doors 19 in the case of the prior art have to be placed onto the rails already prior to the floor coverings 27 being installed and prior to the Z-floor supports 35 being attached. The sliding doors 19 are consequently permanently exposed to dust and mechanical damage.

This is different with the floor guide according to the invention. The floor coverings 27 can be completely installed and the floorer is not disturbed in his job by the sliding doors 19. The floor support 29 can also be cleanly inserted into the receptacle profile thereof and be grouted therein. In order for the sliding doors 19 to now be able to be assembled after the installation of the floor coverings 27, 27[1], the floor support 29 is lifted and placed to one side. Thereafter, according to the first design embodiment of the invention, the screws 41 are released and the central web 39 is lifted from the floor of the guide channel 1. The floor of the guide channel 1 is now free of elements which would impede the horizontal sliding in of the carriage unit 17 and of the T-shaped support profile 23.

Figure 3:
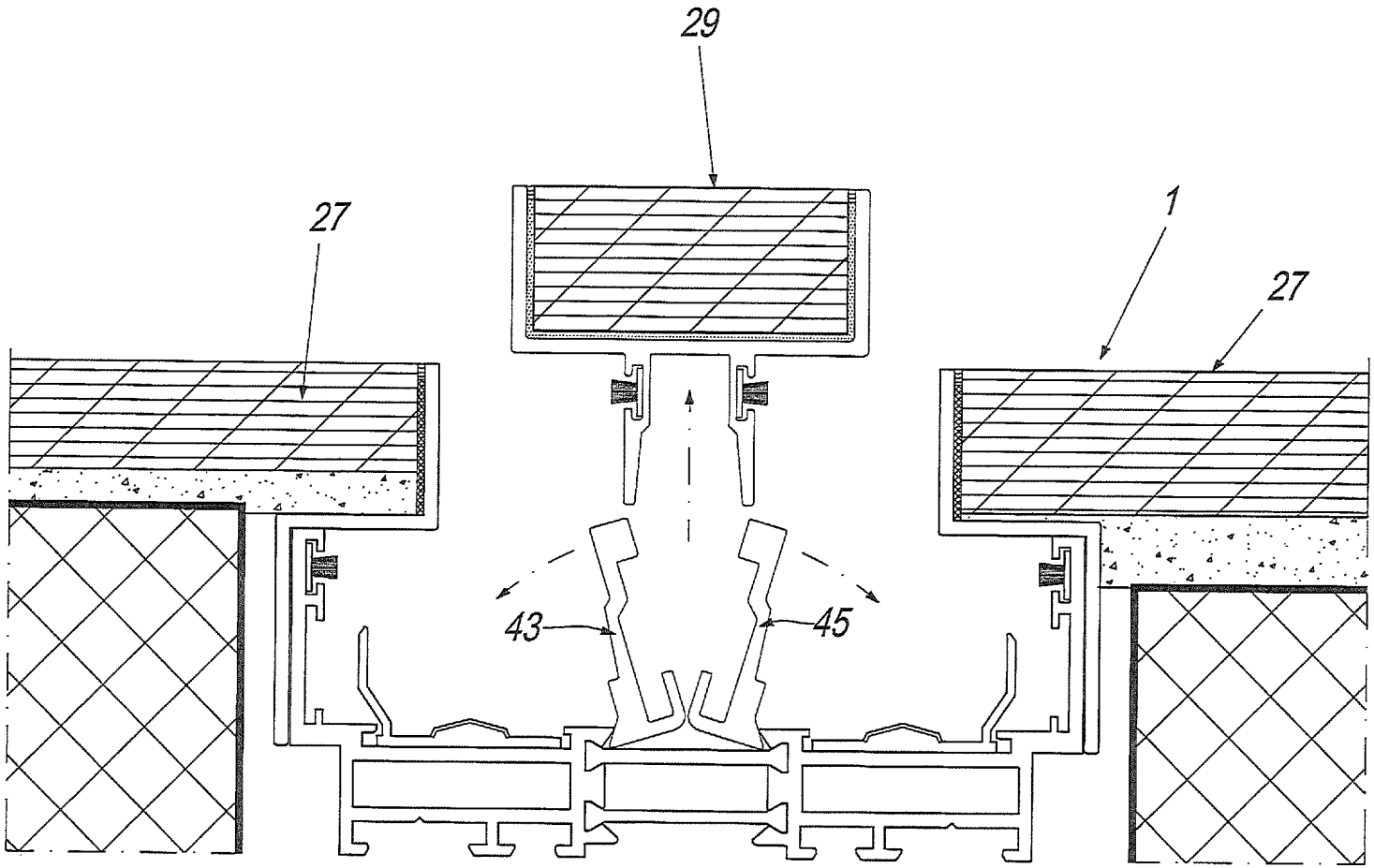
FIG. 3 shows a cross section through a dual-rail floor guide having a guide channel and a sliding door which is mounted in said guide channel and has a central web in two parts, split open prior to being retrieved.

In the second design embodiment of the invention, the two left and right central webs 43 and 45 are no longer held together after the floor support 29 has been lifted, and when slightly pivoted outward can be removed from the floor of the guide channel 1 (FIG. 3).

Figure 5E:
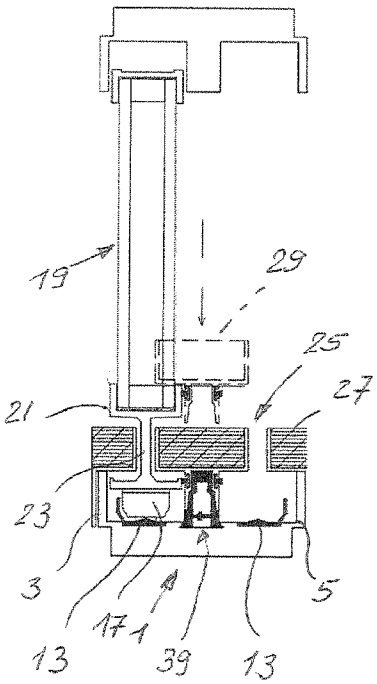
FIGS. 5A-5E show cross sections through floor guides at various points in time of assembling.
Figure 5D:
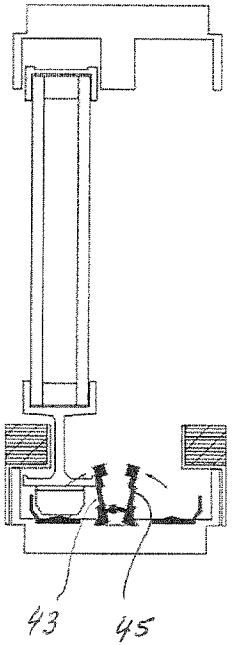
Figure 5C:
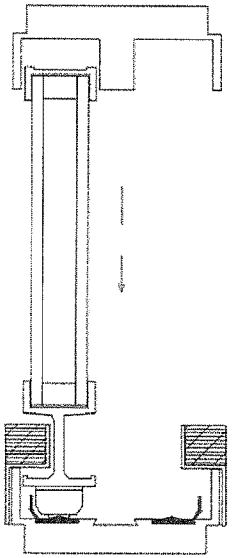
Figure 5B:
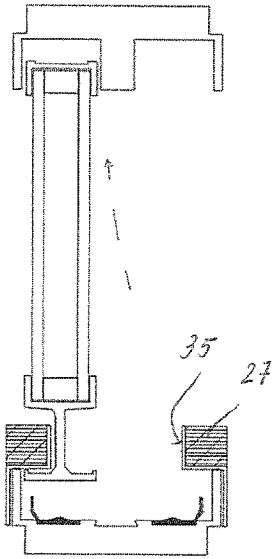
Figure 5A:
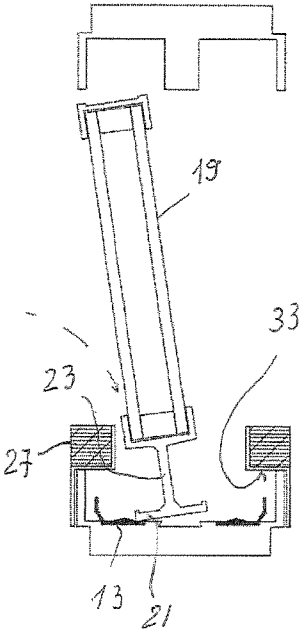

Each sliding door 19 can now be driven into the guide channel 1 through the central upper opening and, in the example in the figures, the right sliding door 19 can then be repositioned to the right and be deposited on the running rail 13. The lower right arm of the profiled flange 21 in this instance comes to lie through the floor covering 27 below the partial cover 33. Driving the left sliding door (FIGS. 5A-5C) in from above and in a slightly tilted manner is subsequently performed through the opening cross section that continues to be configured in a sufficiently wide manner. By way of a minor displacement toward the left, the left half of the profiled flange 21 engages below the floor covering 27 lying to the left, and the sliding door 19 can be deposited on the left running rail 13. The central web 39 (FIG. 5D) is subsequently reinserted in the manner described above, and the floor support 29 (FIG. 5E) is pushed onto the central web 39.

In a reverse procedure, one or both sliding doors 19 can be guided out of the guide channel 1 when required, for instance for service jobs or repairs, and thereafter be inserted again without any destruction of the floor covering 27.

Figure 4:
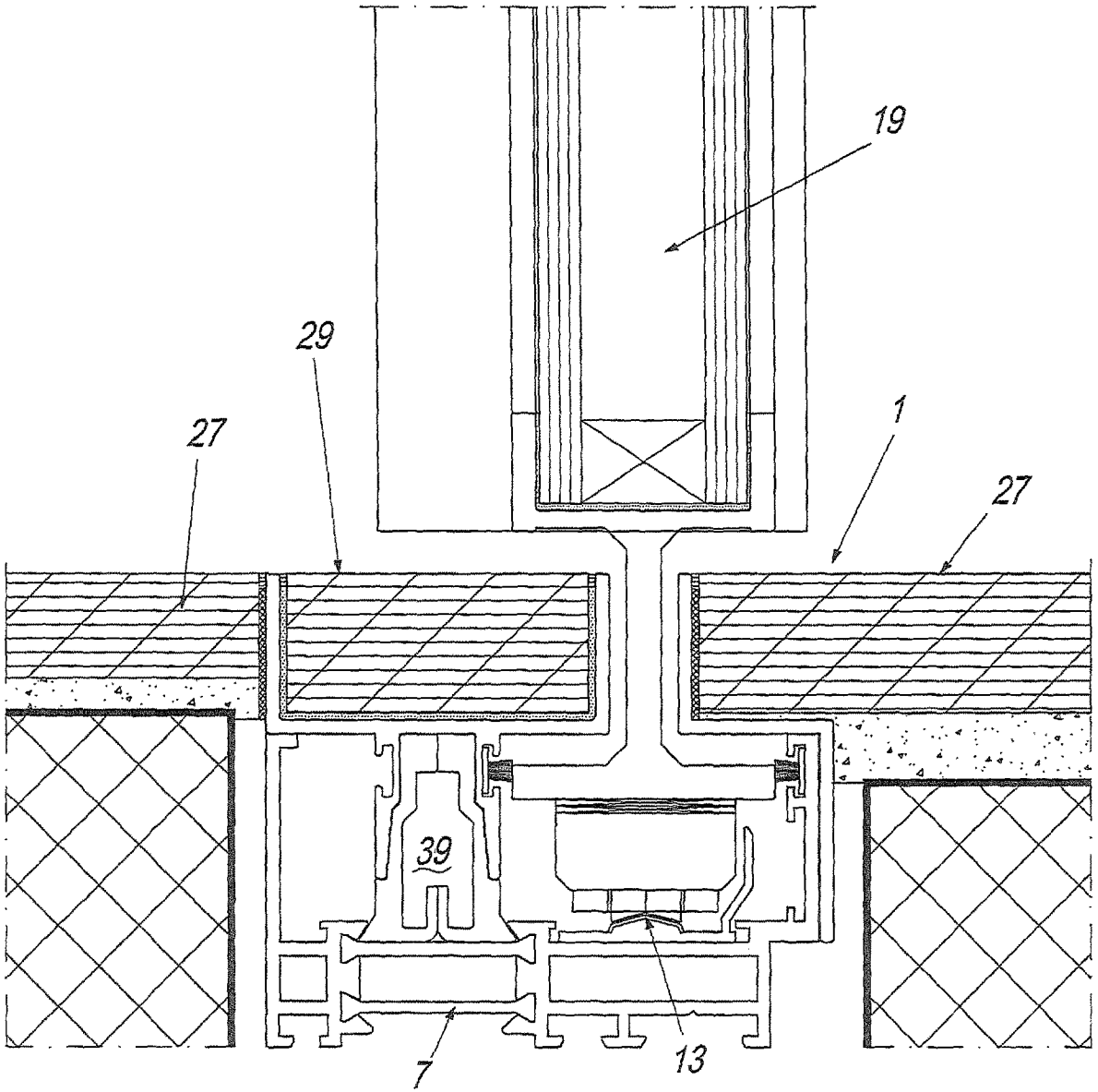
FIG. 4 shows a cross-section through a single-rail floor guide.

A single-rail floor guide is illustrated in FIG. 4. The central web 39 in this embodiment is disposed on the left side of the running rail 13. The central web 39 again stands on the damping web 7 and can either be screw-fitted to the latter, or be embodied in two parts as is illustrated in FIG. 4.

In order to be able to install or uninstall the sliding door 19, the floor support 29 is lifted from the central web 39, and the sliding door is displaced to the left. Said sliding door 19 can then be lifted upward out of the floor guide channel 1.

The invention claimed is:

1. A floor guide for single-rail or multi-rail sliding doors (19), comprising:

a guide channel (1) for running rails (13), a floor support (29) that is adapted to receive a stripe-shaped floor covering (27) thereon, a central web (39), configured in two parts, that is releasably connectable to the floor of the guide channel (1) and configured for fastening the floor support (29) thereon; and wherein the central web comprises a left element (43) and a right element (45) that are configured to be latch-fitted to the floor of the guide channel (1), and the guide channel (1) includes a separate lateral guide portion (53) for each of the left and right elements.

2. The floor guide as claimed in claim 1, further comprising screws (41) that attach the central web (39) to the floor of the guide channel (1), and the screws (41) are releasable from above.

3. The floor guide as claimed in claim 1, wherein the left and right elements (43, 45) of the central web are each configured so as to be pivotable about a longitudinal axis of said elements (43, 45) such that they are adapted to be tilted and lifted from the guide channel (1).

4. The floor guide as claimed in claim 1, wherein the left and right elements (43, 45) of the central web are held together by two legs (37) of the floor support (29) in a non-releasable manner on the floor of the guide channel (1).

5. The floor guide as claimed in claim 1, wherein the central web (39) is comprised of aluminum, plastics material, steel, or stainless steel.

6. The floor guide as claimed in claim 1, wherein the guide channel (1) is adapted to allow removal of two sliding doors (19) and associated carriage units (17) out of the guide channel (1) after removal of the left and right elements (43, 45).

7. The floor guide as claimed in claim 6, further comprising first and second Z-floor supports (35) that are respectively located on each side of the guide channel (1), and are adapted to extend beyond the lateral regions of the floor and are adapted to support the floor coverings (27) on each side of the floor support (29) that is adapted to receive the stripe-shaped floor covering (27[1]) thereon.

8. The floor guide as claimed in claim 1, wherein the central web (39) is latched to the floor of the guide channel (1).

* * * * *